US005973300A

United States Patent [19]

Tomohiro

[11] Patent Number: 5,973,300

[45] Date of Patent: Oct. 26, 1999

[54] METHOD FOR HEATING A PLURALITY OF FOODS UNIFORMLY, AND COOKING HEATER USING THIS METHOD

[75] Inventor: Teruhiko Tomohiro, Ikoma, Japan

[73] Assignee: Masushita Electric Industrial Co., Ltd., Osaka, Japan

[21] Appl. No.: 08/983,081

[22] PCT Filed: Jul. 10, 1996

[86] PCT No.: PCT/JP96/01925

§ 371 Date: Jan. 9, 1998

§ 102(e) Date: Jan. 9, 1998

[87] PCT Pub. No.: WO92/03323

PCT Pub. Date: Jan. 30, 1997

[30] Foreign Application Priority Data

Jul. 12, 1995 [JP] Japan ..... 7-175750

[51] Int. Cl.[6] ..... H05B 1/02

[52] U.S. Cl. ..... 219/497

[58] Field of Search ..... 219/754, 710, 219/702, 711, 712, 715, 506, 497, 707; 426/233

[56] References Cited

U.S. PATENT DOCUMENTS

| | | | |
|---|---|---|---|
| 3,936,626 | 2/1976 | Moore . | |
| 4,456,806 | 6/1984 | Arimatsu | 219/710 |
| 4,467,163 | 8/1984 | Pauley et al. | 219/754 |
| 4,970,359 | 11/1990 | Oh | 219/710 |
| 5,389,764 | 2/1995 | Nishii et al. | 219/506 |
| 5,693,247 | 12/1997 | Bu et al. | 219/711 |

FOREIGN PATENT DOCUMENTS

| | | |
|---|---|---|
| 0 040 638 | 12/1981 | European Pat. Off. . |
| 8-87344 | 4/1993 | Japan . |
| 6-193888 | 7/1994 | Japan . |
| 6-241463 | 8/1994 | Japan . |
| 2113871 | 8/1983 | United Kingdom . |

OTHER PUBLICATIONS

Japanese language search report for Int'l Appln. PCT/JP96/01925 dated Oct. 8, 1996.

English translation of Japanese language search report.

European Search Report for Int'l Appln No. EP 96 92 3057 dated May 6, 1999.

*Primary Examiner*—Tu Ba Hoang
*Assistant Examiner*—Jeffrey Pwu
*Attorney, Agent, or Firm*—Ratner & Prestia

[57] ABSTRACT

An apparatus uniformly heats a plurality of foods in addition to controlling the temperatures of the foods. The heat source has input means, a plurality of temperature detectors, comparison means, and control means. The apparatus detects temperatures of at least two foods, namely one near to the heat source and another far from the heat source by using the temperature detection means, and controls the output of heat from the heat source by comparing these two temperatures with the set-temperature. The apparatus can raise the temperature of foods of lower temperature while maintaining the foods of high temperature at the set-temperature. The plurality of foods can be thus uniformly heated.

42 Claims, 12 Drawing Sheets

Denotes of the Drawings 1. cooking heater
2. door
3. chamber
4. high-frequency generator
5. irradiation opening
6. humidity sensor
7. weight sensor
8. input means
9. temperature detection means
10. comparison means
11. control means
12. step 12
13. step 13
14. step 14
15. step 15
16. step 16
17. step 17
18. step 18
19. step 19
20. step 20
21. step 21
22. step 22
23. high-frequency generator
24. probe type sensor
25. non-contact type thermometer
26. input means
27. temperature estimating means
28. comparison means
29. step 29

30. step 30
31. step 31
32. step 32
33. step 33
34. step 34
35. step 35
36. step 36
37. step 37
38. step 38
39. step 39
40. step 40
41. step 41
42. estimated temperature correcting means
43. comparison means
44. step 44
45. bag
46. thermal conductive material

METHOD FOR HEATING A PLURALITY OF FOODS UNIFORMLY, AND COOKING HEATER USING THIS METHOD

THIS APPLICATION IS A U.S. NATIONAL PHASE APPLICATION OF PCT INTERNATIONAL APPLICATION PCT/JP96/01925.

FIELD OF THE INVENTION

The invention relates to methods using a cooking heater for heating a plurality of foods simultaneously and heating up the foods uniformly so that each of the foods may not be heated up differently in temperature, and relates further to a cooking heater employing these methods.

BACKGROUND OF THE INVENTION

A conventional cooking heater using a high frequency is a microwave oven depicted in FIG. 10. A cooking heater 1 had a front door 2 through which a user can insert or remove foods to/from a chamber 3. A high-frequency-generator 4 is disposed in the cooking heater 1, and the high frequency is irradiated into the chamber 3 through an irradiation opening 5 formed on a ceiling of the chamber 3. The irradiation opening 5 is not always formed on the ceiling, but it may be formed on a rear face or side face. The irradiation opening 5 may be formed in plural. A humidity sensor 6 senses humidity produced by the cooking. The user can identify the cooking progress by using the humidity sensor 6. A weight sensor 7 adjusts a cooking time depending on a weight of each food. These sensors are not always used together, but are used independently or used with other sensors.

When cooking foods by such a cooking heater using a high frequency as described above, several cooking methods are available: (1) heating for a predetermined time, (2) automatic cooking through controlling the operation according to a humidity and weight detected by the sensors, (3) programmed cooking which specifies an output of high frequency and irradiation time in detail. Since these methods are used properly for types of foods, quantities and details of cooking, a good result is obtained depending on a condition.

However, heat values from each food by high-frequency-heating are not the same but differ from each other, therefore, in principal, fine temperature adjustment is difficult for this heating method. It is also difficult for this high-frequency-heating to heat foods uniformly. In the case of heating a plurality of foods simultaneously in the chamber, not only types of foods and quantities, but also location of foods within the chamber changes the heating characteristics. Uniform heating of plural foods thus becomes much more difficult. The problem of uniform heating when heating up plural foods simultaneously is also found in cooking heaters other than the high-frequency cooking heater. For example, when using an oven having a heater on its ceiling, the nearer a food is placed from the ceiling, the sooner the food is heated, and the farther is a food placed to the heater, the slower the heating process. In the case of a convection oven, uniform heating over all of the foods is also difficult, and uneven heating inevitably occurs due to a location of the hot air outlet and placement of food in the chamber.

Although the conventional cooking heater has a function for heating the foods uniformly without unevenness as stated above, it has still a drawback that it cannot heat up plural foods uniformly and simultaneously.

The invention overcomes the above drawback, namely, by heating up the plural foods uniformly when heating up the plural foods simultaneously.

SUMMARY OF THE INVENTION

The first method and cooking heater of the invention for heating up a plurality of foods uniformly can be realized by using a cooking heater comprising the following means:

(1) a heat source for heating a plurality of foods, (2) an input means for inputting a predetermined set-temperature, (3) a plurality of temperature detection means for sensing each detected temperature of the plurality of foods, (4) a comparison means for comparing the detected temperatures with the predetermined set-temperature, (5) a control means for power on or off the heating source based on the comparison result by comparison means, In the cooking heater, the temperature detected at specific time intervals is compared with the set-temperature by the comparison means. When all the detected temperatures from the plurality of temperature detection means are lower than the set-temperature, the control means powers on the heat source, and when any one of the detected temperatures is higher than the set-temperature, the control means powers off the heat source. At the moment when all the detected temperatures exceed the set-temperature, the control means controls the heat source so that all the controls may end after a specified time.

At least one of the temperature detection means preferably detects the temperature of foods placed at the farthest place from the heat source, and another one of the temperature detection means preferably detects the temperature of foods placed at the nearest place to the heat source.

At least one of the temperature detection means preferably detects the temperature at the center of the biggest food, and another temperature detection means preferably detects the temperature on the surface of the smallest food.

Through the above structure, the temperature of the food placed at the farthest place from the heat source is detected by one of the temperature detection means, and another temperature detection means detects the temperature of the food placed at the nearest to the heat source. In general, the nearer a food is placed to the heat source, the sooner heating progresses, and the farther food is placed from the heat source, the slower heating progresses. These two detected temperatures hence represent the highest and lowest temperatures of all foods in the chamber. All the detected temperatures including these two are periodically compared with the set-temperature by the temperature comparison means. Based on the comparison results, when all the detected temperatures are lower than the set-temperature, the heat source is turned on, and when at least one of the detected temperature exceeds the set-temperature, the heat source is turned off. This operation prevents the foods from being heated up to a temperature higher than the set-temperature. During the turn-off period of the heat source, nothing other than heat dissipation from the foods as well as heat conduction within the foods progresses. In each food, heat conduction from the higher part to the lower part progresses, and whereby the food is heated up uniformly. The heat dissipated from the higher temperature part of foods warms the air in the chamber, whereby a lower temperature part of foods can be warmed. As a result, the uniform heating of the plurality of foods progresses. Further, after every detected temperature exceeds the set-temperature, the specified time-control is still continued, and whereby the temperatures of all the foods reach the set-temperature.

In addition, one of the plurality of temperature detection means detects the temperature at the center of the largest food, and another one detects the surface temperature of the smallest food, whereby the temperatures both of most difficult and easiest foods to heat by the high-frequency-heating can be detected.

The second method and cooking heater of the invention for heating up a plurality of foods uniformly can be realized by using a cooking heater comprising the following means:

(1) a heat source for heating a plurality of foods, (2) an input means for inputting the information about the foods and heating thereof, and a predetermined set-temperature, (3) a temperature detection means for sensing a temperature of the foods, (4) a temperature estimating means for estimating a temperature of the foods, (5) a comparison means for comparing the detected temperature detected by the temperature detection means, the estimated temperature estimated by the temperature estimating means, and the set-temperature with each other, (6) a control means for power on or off the heat source based on the comparison result by comparison means.

In the cooking heater, the temperature detection means detects a temperature of at least one of the foods, and the temperature estimating means estimates a temperature of another food. When both of the detected and estimated temperatures are judged by the comparison means lower than the set-temperature, the heat source is turned on. When either one of the two temperatures is judged higher than the set-temperature, the heat source is turned off. At the moment when both the detected and estimated temperatures are judged higher than the set-temperature, the control means controls the heat source so that all the controls may end in a specified time.

The temperature estimating means among others is preferably determined by neuro-technology based on a theoretical analysis, and whereby an accuracy of estimating a temperature can be improved.

The uniform heating method explained above employs the temperature detection means together with the temperature estimating means, e.g. the temperature of the location to be most precisely controlled is detected by the temperature detection means, and the temperature of the other location is estimated by the temperature estimating means. The uniform heating can be achieved by applying the same comparison method described in the above.

In order to heat the plurality of foods uniformly, the temperature estimating means has an estimated temperature correcting function which is incorporated into the cooking heater. This correcting function corrects the estimated temperature by using the detected temperature, whereby a correct estimated temperature can be obtained. As a result, the plurality of foods can be heated up uniformly, and the accuracy of uniformity is substantially improved.

High frequency electric power is preferably used in this invention, thereby the structure can remarkably produce the above effects. When using the high frequency electric power in the above structure, the temperature in the chamber is, in general, lower than that of the foods. The plurality of foods are preferably recommended to be put into one bag, thereby dissipated heat and steam from a place of higher temperature of the foods fill the bag. This phenomenon encourages the temperature shift from a higher temperature location to the lower temperature location in the bag. The plural foods are recommended to be wrapped up or sandwiched with a heat conductive material, whereby heat from a higher temperature location may shift to a lower temperature location.

EXEMPLARY EMBODIMENTS OF THE INVENTION

Figure 1:
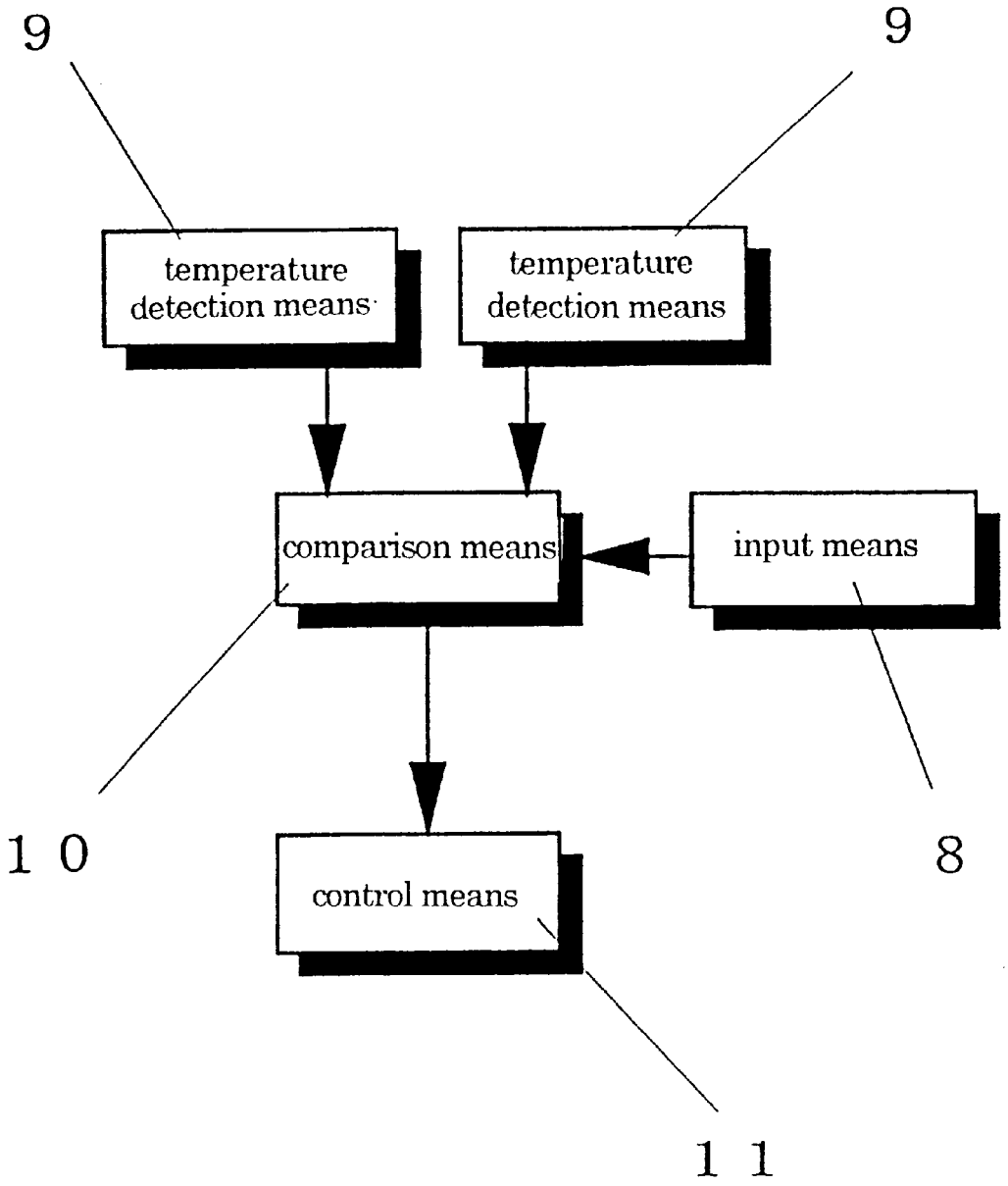
FIG. 1 is a block diagram depicting a system structure of the first uniform-heating-method for a plurality of foods according to this invention.

FIG. 1 is a block diagram depicting a structure of the cooking heater embodying the uniform-heating-method for a plurality of foods. An input means 8 is e.g. a keyboard, push buttons, or a dial for inputting a set-temperature, such as a proper temperature to be which food is to be heated to. A temperature detection means 9 is e.g. a thermometer for detecting a temperature of foods. A thermocouple or thermistor may be used as the temperature detection means. One or more types of temperature detection means are disposed at a plurality of places in order to simultaneously detect the temperatures thereof. A comparison means 10 compares the set-temperature input from the input means 8 with the detected temperatures detected by the temperature detection means 9. Comparison means 10 then sequentially takes out a plurality of the detected temperatures and examines them with the set-temperature according to a large-small relationship. Based on the comparison results, the comparison means 10 sends a signal adjusting the heat source to a control means 11. The control means 11 receives the signal from the comparison means 10 to turn on or turn off the heat source, whereby uniform-heating is achieved.

Figure 2:
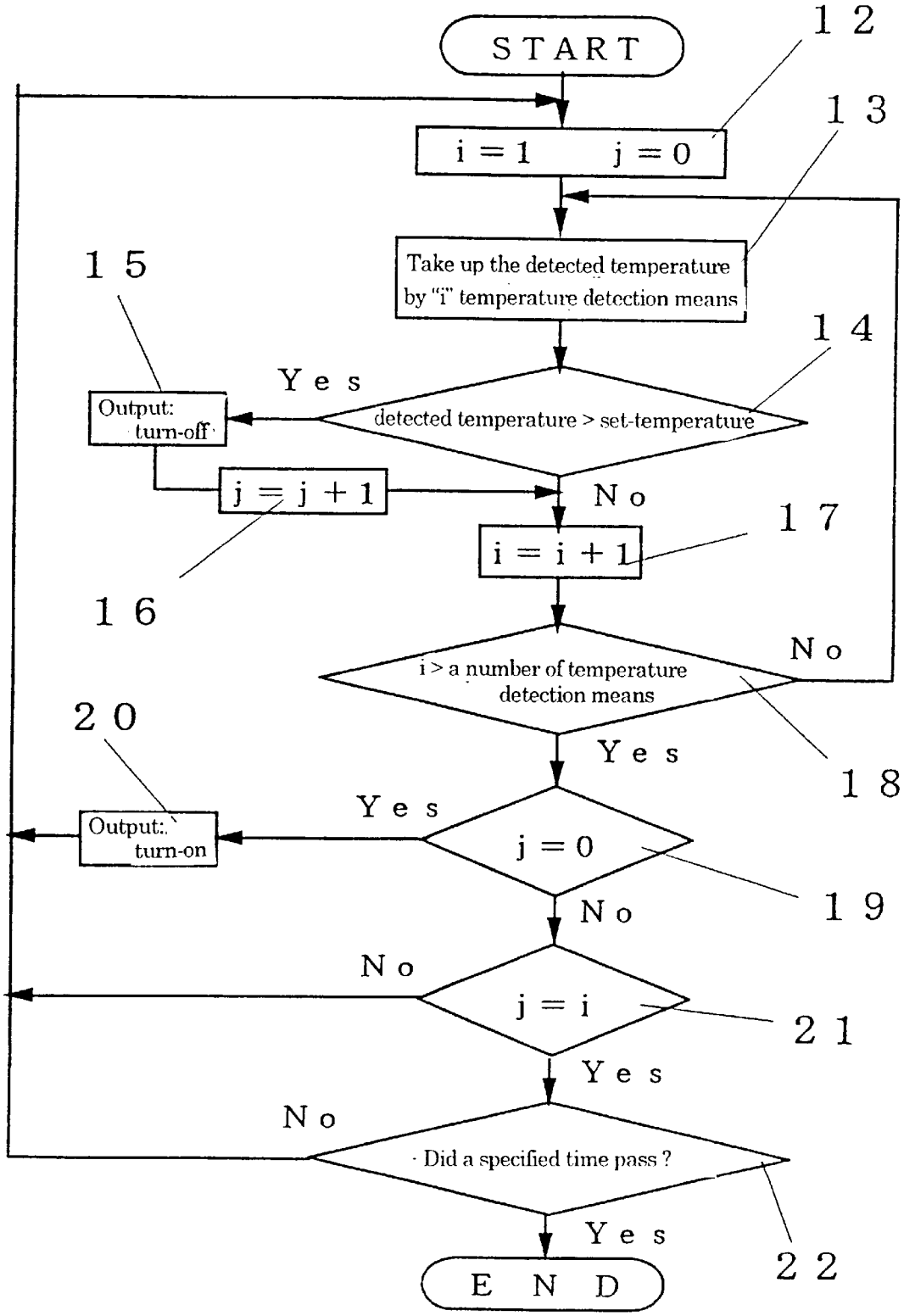
FIG. 2 is a flowchart depicting an operation of an embodiment of the uniform-heating-method shown in FIG. 1.

FIG. 2 is the flowchart detailing the operation of comparison means 10. When the heating is started, two parameters "i" and "j" are first initialized (Step 12.) Then, a temperature is detected by the first temperature detection means (Step 13.) The detected temperature is compared with the set-temperature (Step 14.) When the detected temperature is higher than the set-temperature, the comparison means 10 sends the signal of turning off the heat source to the control means 11 (Step 15.) Then the parameters "i" and "j" are increased by 1 (one) (Step 16 and 17.) At Step 14, when the set-temperature is higher than the detected temperature, only the parameter "i" is increased by 1 (one) (Step 17.) At this point, the parameter "i" is compared with the total number of temperature detection means 9 (Step 18.) When the total number is greater than the parameter "i", the operation returns to Step 13 in order to detect the next temperature.

When the comparisons of all the detected temperatures with the set-temperature are completed, the parameter "j" is checked to determine whether it is "0" or not (Step 19.) When "j" is "0", in other words, all the detected temperatures are lower than the set-temperature, the signal to turn on the heat source is sent to the control means 11 (Step 20.) Then Step 12 is repeated after a specified interval. When "j" is not equal to "0", "j" is compared with "i" (Step 21.) When "j" is not equal to "i", it means that some of the detected temperatures are lower and the other detected temperatures are higher than the set-temperature, in other words, the heat source is turned off. During this turn-off period, heat is shifted from the place of the higher temperature than the set-temperature to the place of the lower temperature. During the course of time, the temperature of higher temperature place becomes lower than the set-temperature, or the temperature of lower temperature place becomes higher than the set-temperature. In this case, the comparison operation from Step 12 is repeated after a some interval.

At Step 21, when "j" is equal to "i", it means that all the detected temperatures exceed the set-temperature, and the heat source is turned off. All the foods are supposed to be heated up uniformly on Step 21; however, the heating is completed after a some interval (Step 22) when "j" becomes equal to "i". This is because some places might still remain at temperatures lower than the set-temperature, and a germicidal effect can be gained by keeping the set-temperature over a period of time.

Figure 3:
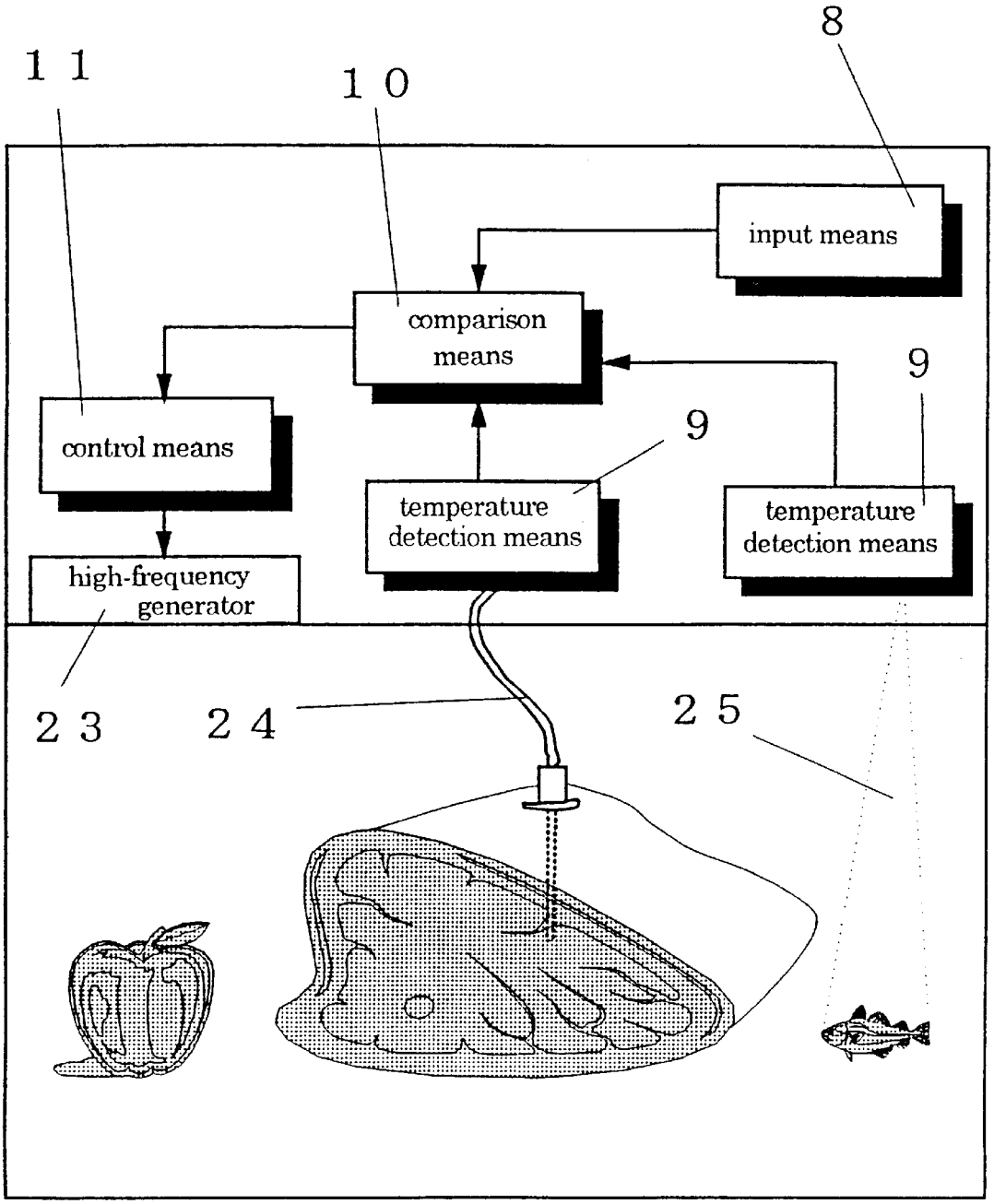
FIG. 3 is a simple diagram depicting a structure of a cooking heater using a high frequency for the uniform-heating-method shown in FIG. 1.

FIG. 3 is a diagram depicting an embodiment of a temperature detecting method in the case of employing a high frequency heat source. The structure shown in FIG. 3 is roughly the same as that shown in FIG. 1; however, the heat source employs a high-frequency-generator 23. One of the plurality of temperature detection means 9A measures a temperature at the center of the largest food, and another temperature detection means 9B detects a surface temperature of the smallest food. This method takes the general characteristics of high-frequency-heating into consideration, i.e. the center of a large food is the hardest place to heat up, and the surface of a small food is the easiest to heat up. Accordingly, if the temperatures of these two points can be detected, approximate temperatures of the highest and lowest of the plurality of foods to be heated up can be monitored. Therefore, the uniform-heating can be achieved by detecting the temperatures of these two points at a minimum. The plurality of temperature detection means 9A, 9B consists of minimum two means, and if temperatures at more places could be detected, an accuracy of the uniform-heating is improved.

Regarding the temperature detection means 9A, 9B, a probe sensor 24 as shown at the center in FIG. 3 and a non-contact thermometer 25 as shown at the right in FIG. 3 can be used together. Through the structure shown in FIG. 3, the temperatures of each place can be precisely detected. Since a thermistor or a thermocouple is incorporated into the tip of the probe sensor, a temperature of any place of a food can be detected by just inserting the probe sensor into the food. A thermometer employing optical fibers also can be used as the temperature detection means. When using the thermistor or a thermocouple among others together with the high-frequency-heat source, the probe should be shielded from a cable in order to avoid the noise due to a high frequency. A thermometer employing infrared rays is often used as the non-contact thermometer 25 which enjoys a benefit of determining a food temperature without touching the food; however it cannot determine an inner temperature of the food.

Figure 4:
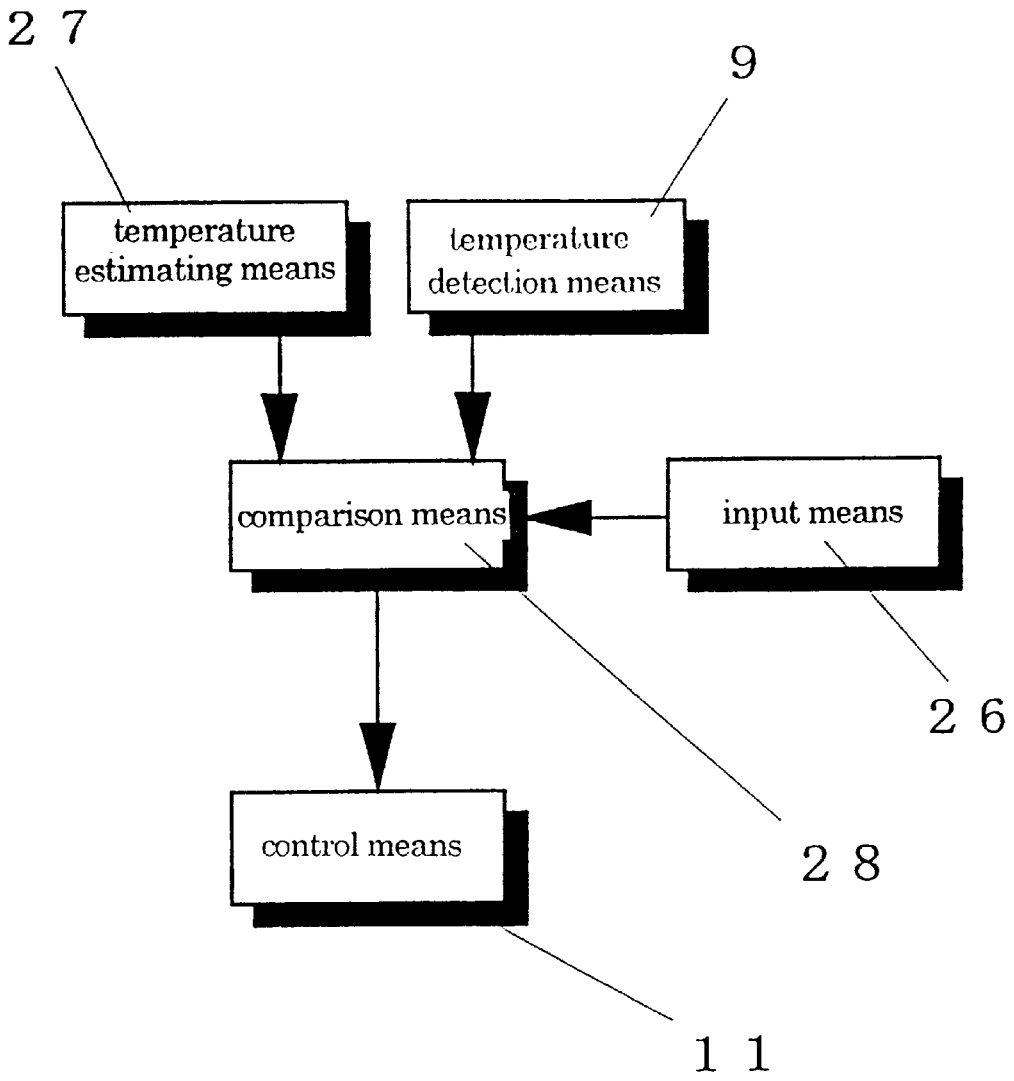
FIG. 4 is a block diagram depicting a system structure of an embodiment of the second uniform-heating-method for a plurality of foods according to this invention.

FIG. 4 is a block diagram depicting a hardware structure of a second Embodiment for the uniform heating of a plurality of foods according to this invention. The temperature detection means 9 and the control means 11 are the same those shown in FIG. 1, accordingly the descriptions are not repeated here. An input means 26 has a function of inputting a set-temperature and the information about a plurality of foods. A temperature estimating means 27 estimates the raised temperatures of the foods based on the actual heating applied thereto since the heating is started.

Figure 5:
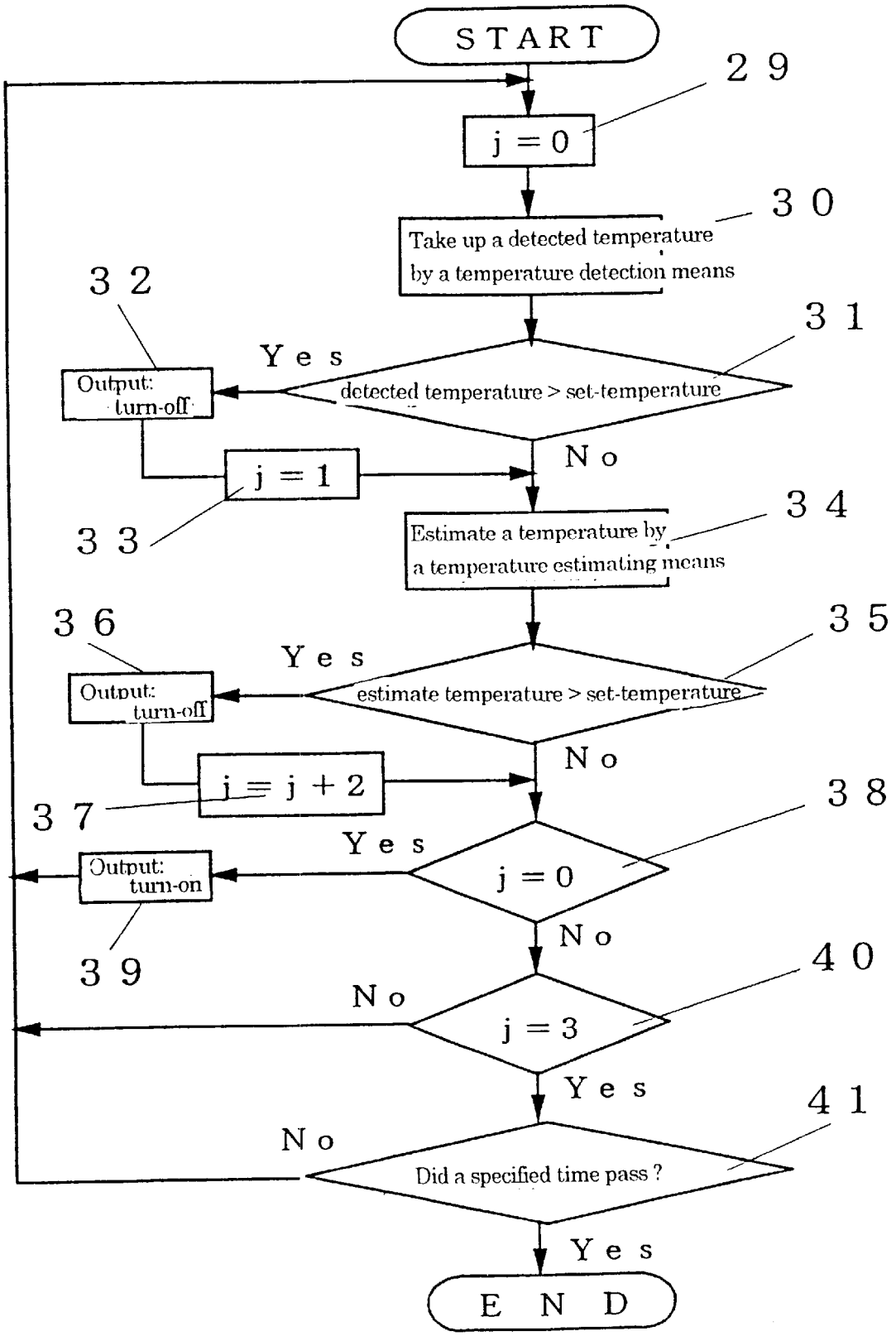
FIG. 5 is a flowchart depicting an operation of the uniform-heating-method shown in FIG. 4.

FIG. 5 is a flowchart depicting a practical operation of a comparison means 28. First, the parameter "j" is initialized (Step 29.) Then the temperature detected by the temperature detection means 9 are input (Step 30) and compared with the set-temperature (Step 31.) When the detected temperature is higher than the set-temperature, the signal for turning off the output is sent to the control means 11 (Step 32.) Then the parameter "j " is set to be equal to "1" (Step 33), after that temperature estimation is conducted (Step 34.) When the set-temperature is higher in Step 31, the operation moves directly to Step 34 (temperature estimation.)

The temperature estimation is conducted at one or more predetermined places. Another available method to determine the places for the temperature estimation is to automatically select the hardest or easiest place to heat from the inputted information about the foods. When the temperature is estimated, it is compared with the set-temperature (Step 35.) When the estimated temperature is higher than the set-temperature, the signal for turning off the heating output is sent to the control means (Step 36.) Then the parameter "j " is set to be equal to "j+2" (Step 37) before the operation moves to Step 38. If the set-temperature is higher than the estimated temperature, the operation moves directly to Step 38, where the parameter "j" is judged to be "0" or not. When "j" is judged to be equal to "0", it means that both the detected and estimated temperatures are lower than the set temperature, the signal for turning on the heating output is sent (Step 39), and the operation returns to Step 29 after a time interval. When "j" is judged not to be equal to "0", then "j" is judged whether it is equal to "3" or not (Step 40.) When the parameter "j" is equal to "3", both the detected and estimated temperatures are higher than the set-temperature. When the parameter is not equal to "3", either one of the detected temperature and estimated temperature is higher and the other one is lower than the set-temperature. When "j" is not equal to "3", the operation returns to Step 29 after a time interval and repeats the steps thereafter. When "j" is equal to "3", the heating is completed after keeping this status in a certain period (Step 41.)

The number of temperature detection means 9 can be reduced by employing the temperature estimating means 27. The temperature of the most important place may only be detected firsthand by the temperature detection means 9, and the other temperatures of other places may be controlled by the temperature estimating means 27. FIG. 5 shows an example of estimating a temperature at only one place; however, the number of places of which temperatures may be estimated may be increased, and then the uniform-heating can be achieved by using an approximately same comparison means as described above.

The temperature of the food placed farthest from the heat source is detected by the temperature detection means 9 firsthand, and the temperature of the food placed nearest to the heat source is estimated by the temperature estimating means 27. These two means thus used appropriately, whereby the components for temperature detecting can be moved away from a possible hot-place near to the heat source. Considering a response speed of the temperature detector, it is able to measure a moderate change in temperature, which is expected at a place farther from the heat source, because a temperature of a place close to the heat source is expected to rise sharply.

Another example is introduced: a temperature of the largest food is detected by the temperature detection means 9, on the other hand, a temperature of the smallest food is estimated by the temperature estimating means 27. In this case, the temperature that moderately rises may be measured by the hardware, namely, the temperature detection means 9, whereby a more accurate measuring can be expected.

In order to improve the accuracy of the temperature estimating means 27, the following method is introduced: when estimating a temperature, several factors should be considered such as a heating output, type of foods, size, weight and shape of the foods, location of the food in the chamber, environmental temperature, air current speed in the chamber, and dispersion of foods and output of power supply. The accuracy of temperature estimation depends on how many above factors can be taken into consideration. Considering all the factors is impractical because it makes conditions and operation complicated. Therefore, two or more factors influencing the temperature estimation substantially are selected from the factors including, heating output, type of foods, weight and shape of foods, and location of foods in the chamber. Only the selected factors among them should be taken into consideration. This may be a practical method.

Figure 6:
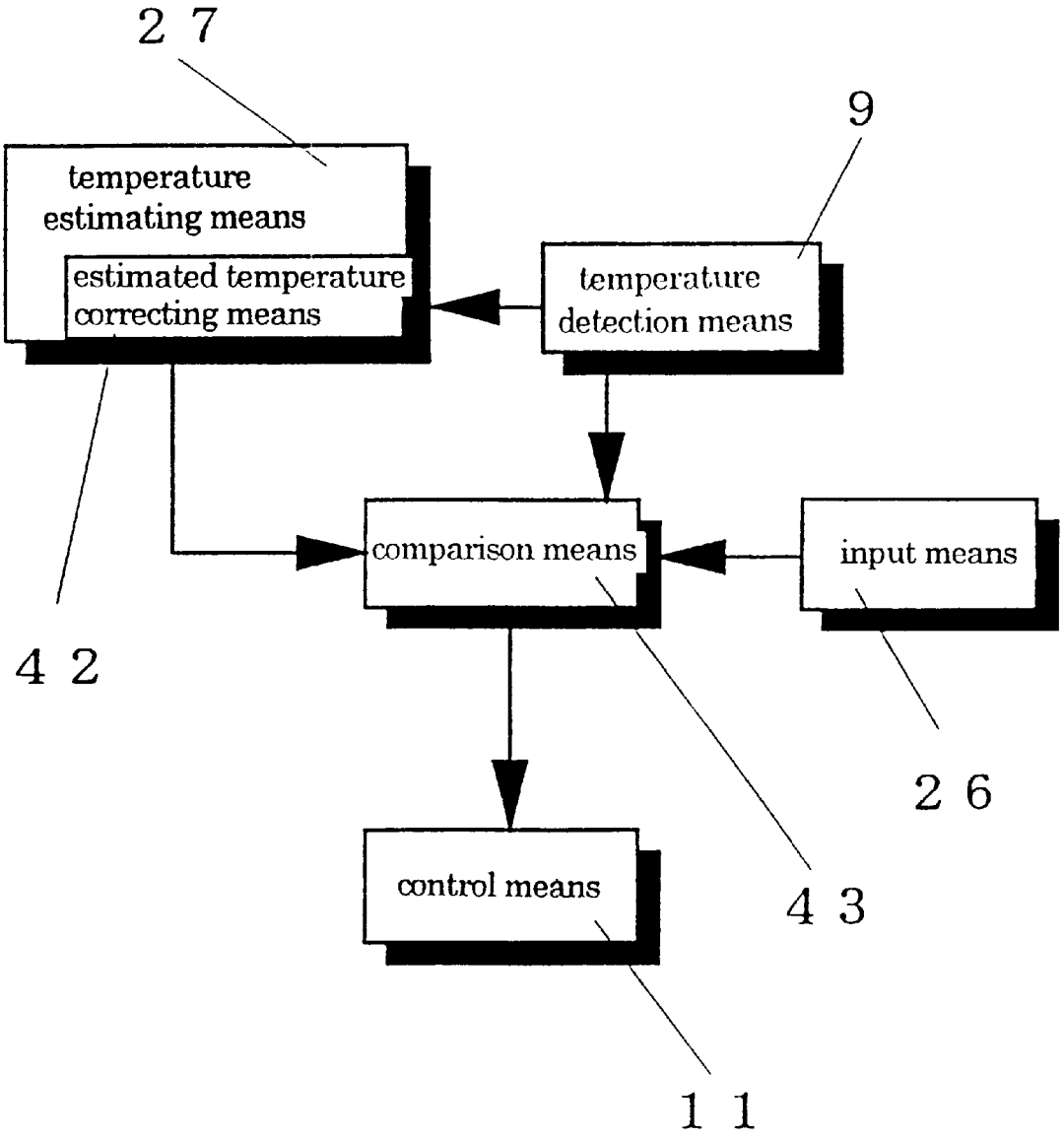
FIG. 6 is a block diagram depicting a system structure of another embodiment of the second uniform-heating-method for a plurality of foods according to this invention.

FIG. 6 is a block diagram depicting another hardware system for improving the accuracy of temperature estimation. In addition to what is shown in FIG. 4, a temperature-estimation-correcting function 42 is incorporated into the temperature estimating means 27. This correcting function 42 corrects an estimated temperature by using a detected temperature gained by the temperature detection means 9. As described in the paragraph above, it is necessary to consider various factors to estimate temperatures; however, it is impossible to verify how accurately the temperatures are estimated with regard to actual temperatures in each heating process. The system shown in FIG. 6, therefore, compensates the estimation accuracy: estimate the temperature by using the temperature estimating means 27 at the place where temperature is actually measured by the temperature detection means 9, and compensate the estimation accuracy by using the difference between the actually measured temperature and the estimated temperature. For example, when an estimated value is lower than a measured value at a measuring point, other estimated temperatures are also judged lower than the actual temperature. Then the estimated temperatures are corrected to higher ones.

Figure 7:
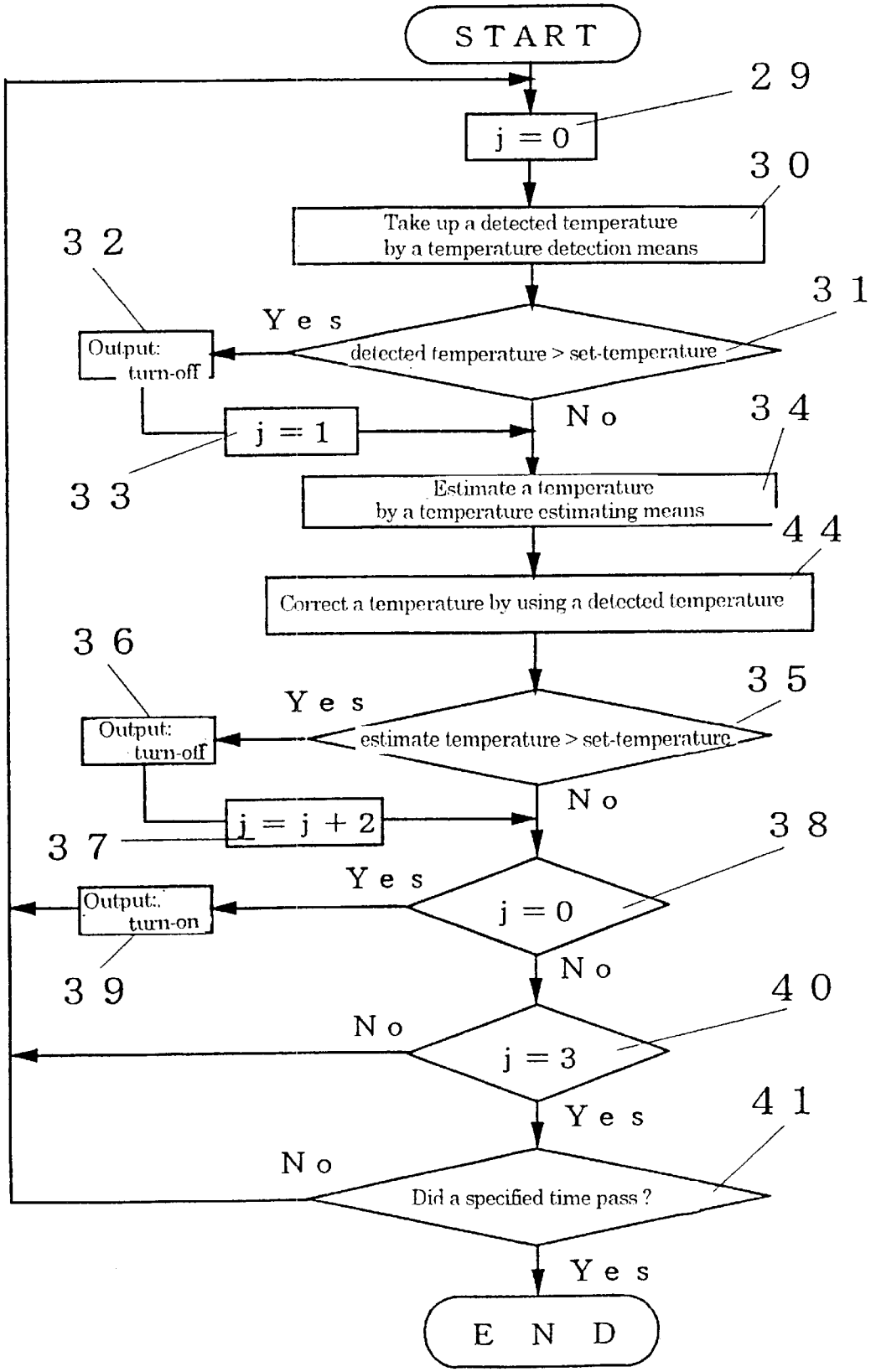
FIG. 7 is a flowchart depicting an operation of heating method shown in FIG. 6.

FIG. 7 is a flowchart depicting the practical processes of a comparison means 43 in the above case. The process flow shown in FIG. 7 is almost the same as explained in FIG. 5. The only difference is that a process of correcting an estimated temperature (Step 44) is added after estimating a temperature in Step 34. The correction is actually processed as explained above in Step 44. Namely, estimate the temperature of the place of which temperature is measured by the temperature detection means 9, and compare the estimation with the detected temperature, then correct other estimated temperatures based on the comparison result. Various methods can be suggested for the quantization of correction, such as using an absolute value of a difference between compared temperatures, or using a ratio of the compared temperatures.

It was already discussed that various factors should be taken into consideration in estimating temperatures; however, a method of estimation is another issue. Estimation methods in the heating process may be suggested as follows: estimation calculated theoretically based on various conditions, estimation based on the same kinds of experimental data collected, etc. These methods are impractical because of calculation time and stored data volume. One of the embodiments of this invention employs neuro-technology through which temperatures can be estimated accurately and easily with small data volume. The neuro-technology employs an idea of neural network which is devised on the model of operation of a human brain, and can deal systematically with various data which are hard to formulate Experimental data and data gained through theoretical analysis can be used by this neuro-technology.

In this Embodiment 2, a high-frequency-heating among others is preferred as a heat source in order to realize the uniform heating for a plurality of foods.

When using a high-frequency-heating as a heat source, it does not raise the temperature so much in the chamber as an electric heater does. Some device is required to transfer the heat from a higher temperature place to a lower temperature place.

Figure 8:
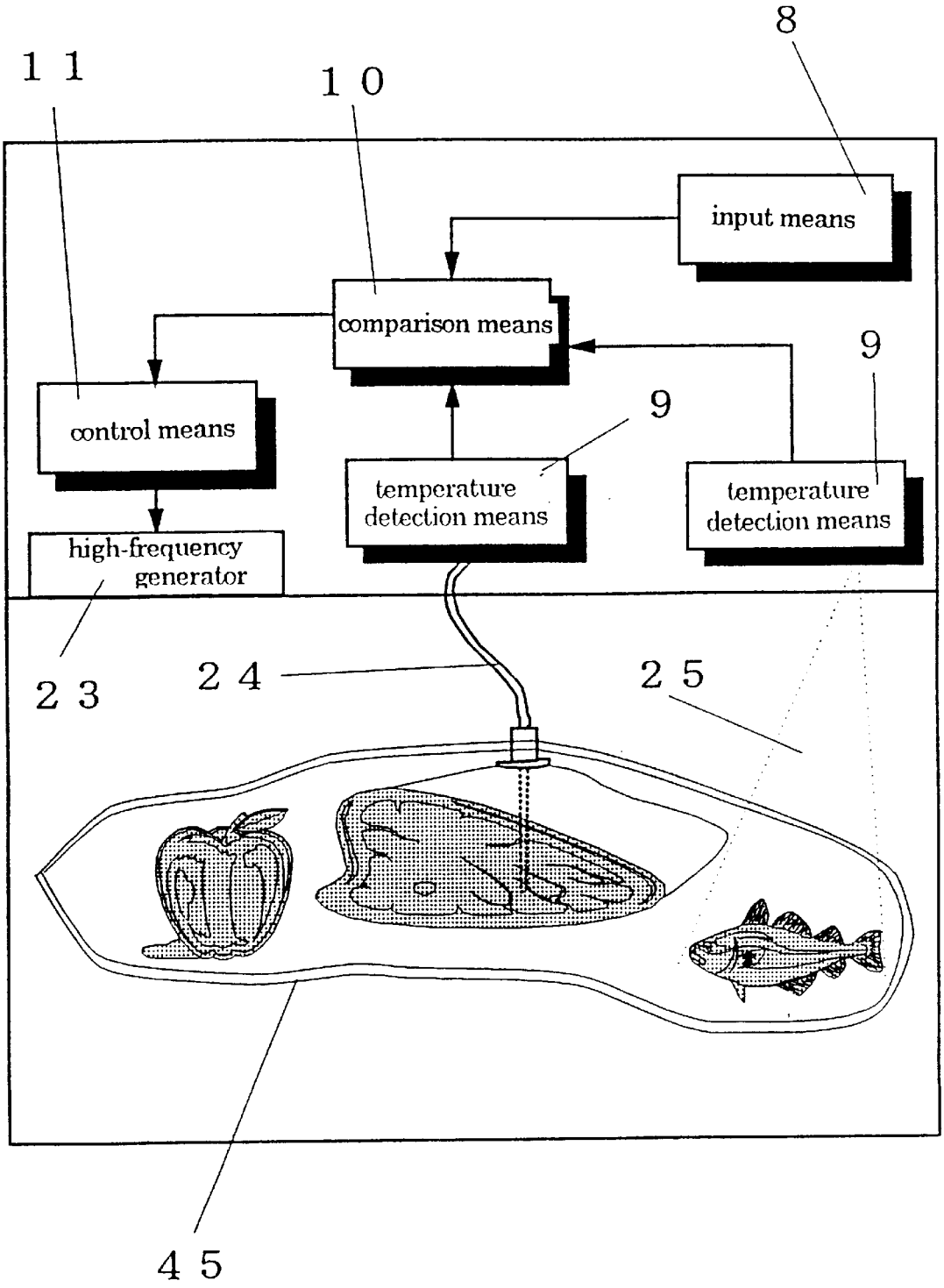
FIG. 8 is a simple diagram depicting an embodiment where a high-frequency-heat source is employed and foods are put into a bag sealed.

FIG. 8 depicts a structure using a high-frequency as a heat source, where a plurality of foods are put into a bag and heated. A bag 45 is not necessarily a specific one but should have heat resistance against a cooking temperature and should be made of a material not generating so much heat due to a high frequency. In the case of a cooking temperature up until 100° C., a bag made of polyethylene or polypropylene can be used. The bag 45 containing foods does not require a vacuum pack, but may be degassed to some degree. When heating the bag 54 containing foods, heat and steam generated by the heating fill the bag 45, thus places of lower temperatures can be effectively heated.

Figure 9:
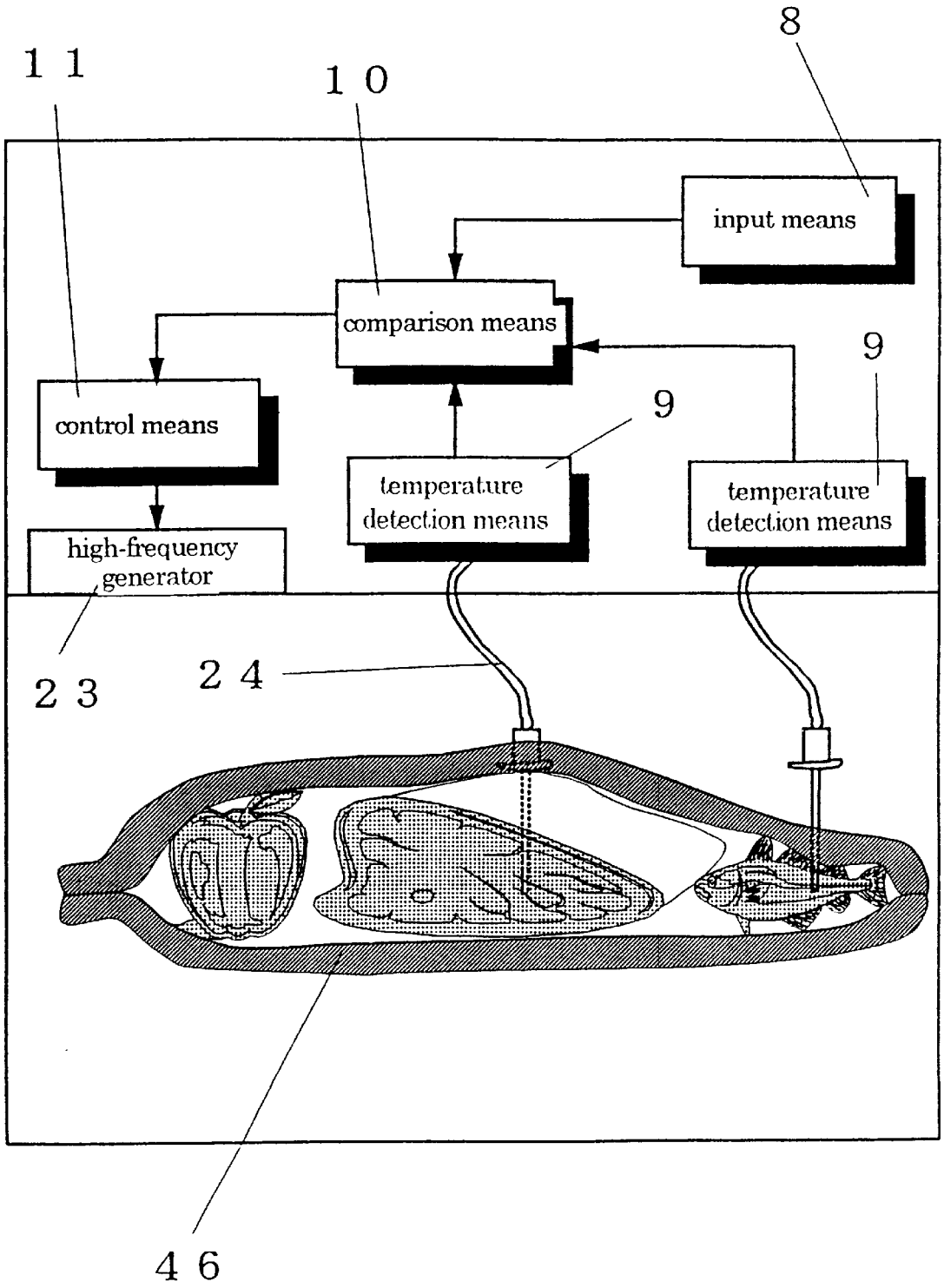
FIG. 9 is a simple diagram depicting an embodiment where a high-frequency-heat source is employed and foods are sandwiched by a heat conducting material.
Figure 10:
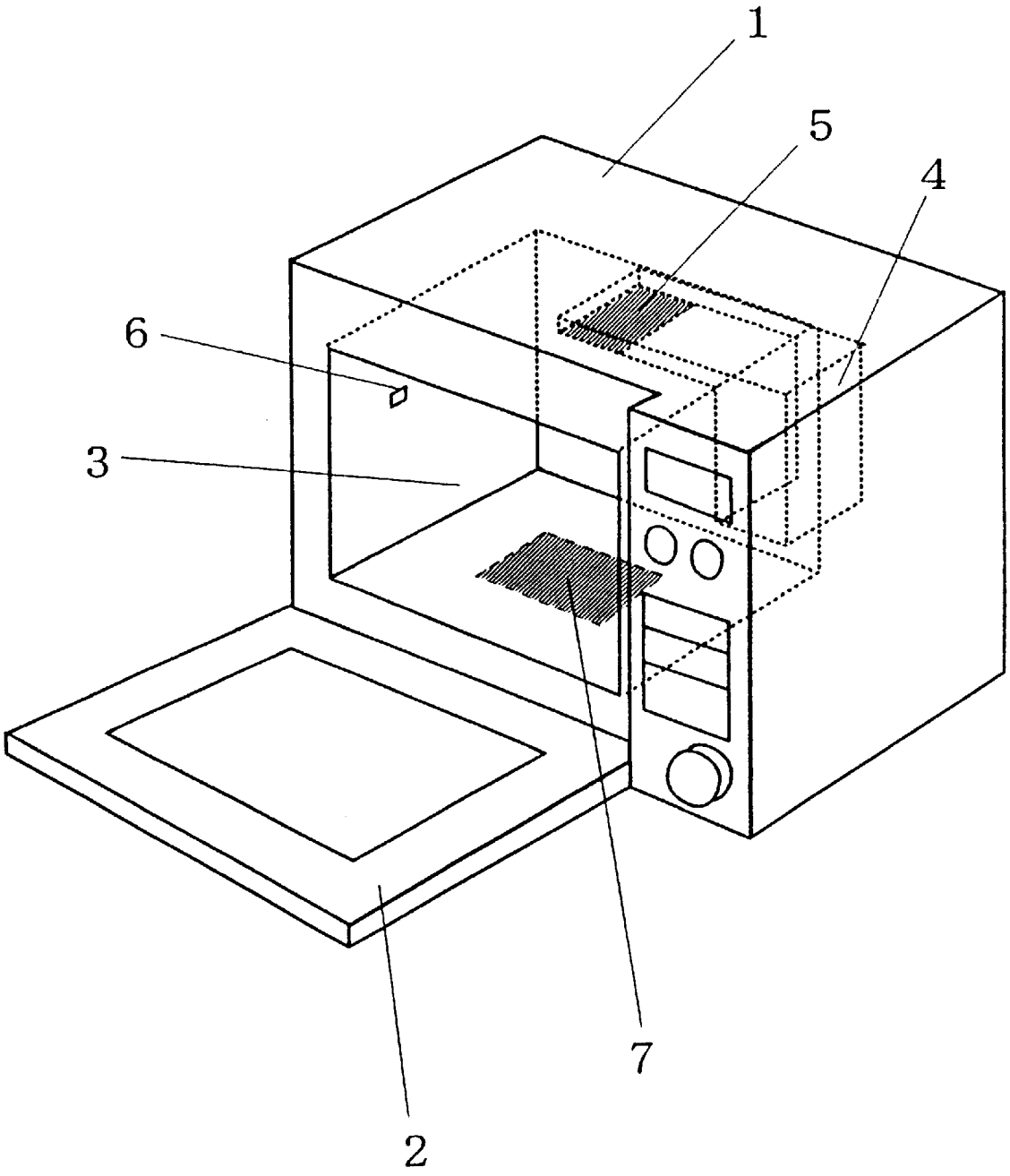
FIG. 10 is a perspective view of a conventional high-frequency-heating-apparatus.

FIG. 9 depicts a structure using a high-frequency as a heat source, wherein a plurality of foods are placed between heat conductive materials. A heat conductive materials 46 moves the heat from higher temperature places to lower temperature places. The heat conductive material thus must contact closely to foods, and not to generate so much heat due to a high frequency. For example, a cloth impregnated with salad oil or a mat made from a bag filled with oil is used. This structure transfer the heat from the higher temperature places to the lower temperature places effectively, although the high frequency heating does not raise the temperature so much in the chamber. As a result, the uniform heating on a plurality of foods can be realized.

Industrial Applicability

According to the above explained heating methods and cooking heaters of this invention, a plurality of foods can be heated uniformly. To be more specific, a plurality of temperature detection means are used for detecting a temperature of a food located near to the heat source as well as another temperature of a food located far from the heat source. These detected temperatures are compared with a predetermined set-temperature, whereby the heat source can be controlled. The uniform heating of a plurality of foods can be thus achieved.

Another method is to use a temperature estimating means together with the temperature detection means, and whereby the temperature which is hard to measure by the temperature detection means can be estimated. According to this method, although a number of temperature detection means is reduced, the uniform heating of a plurality of foods can be still realized.

The above uniform heating methods are not limited to a specific heat source, but a high-frequency-heating can be used too: the high-frequency-heating has a characteristic problem of unevenness in heating; however, this problem is solved by devising the structure of temperature detection means as well as employing a heating structure which promotes heat-moving from a higher-temperature-place to a lower-temperature-place. The heat source employing the high-frequency, among others, can realize excellent uniform heating.

When using the temperature estimating means, an estimation accuracy can be improved by increasing a number of factors of heating and foods to be considered, or by correcting an estimated temperature with a measured temperature gained by the temperature detection means or by applying neuro-technology. Temperature controlling in the uniform heating can be remarkably simplified through this structure.

What is claimed is:

1. A method for uniformly heating a plurality of foods using a heat source comprising the steps of:

inputting a set-temperature, detecting a respective plurality of temperatures for each of said plurality of foods, comparing the respective plurality of detected temperatures with a predetermined set-temperature, controlling said heat source based upon the comparison, comparing said respective plurality of detected temperature detected at predetermined time intervals with said set-temperature, and activating said heat source when all of said plurality of detected temperatures are lower than said predetermined set-temperature, wherein at least one of said plurality of detected temperatures is a temperature of a first food of the plurality of foods, said first food being placed farthest from said heat source, and at least another one of said plurality of detected temperatures is a temperature of a second food of the plurality of foods, said second food being placed nearest to said heat source.

2. A method for uniformly heating a plurality of foods using a heat source comprising the steps of:

inputting a set-temperature, detecting a respective plurality of temperatures for each of said plurality of foods, comparing the respective plurality of detected temperatures with a predetermined set-temperature, controlling said heat source based upon the comparison, comparing said respective plurality of detected temperature detected at predetermined time intervals with said set-temperature, and activating said heat source when all of said plurality of detected temperatures are lower than said predetermined set-temperature, wherein at least one of said plurality of detected temperatures is a temperature of a largest food of the plurality of foods, and at least another one of said plurality of detected temperatures is a temperature of a smallest food of the plurality of foods.

3. The method of claim 2, wherein the temperature of said largest food is represented by a temperature at a center of the largest food, and the temperature of the smallest food is represented by a temperature on a surface of the smallest food.

4. The method of claim 1 or 2, wherein at least one of said plurality of temperatures is detected by a contacting sensor, and at least another one of said plurality of temperatures is detected by a non-contacting sensor.

5. The method of claim 1 or 2, wherein at least one of said plurality of temperatures is detected by at least one of a thermocouple and a thermistor, and at least another one of said plurality of temperatures is detected by an infrared radiation sensor.

6. The method of claim 1 or 2, wherein said heat source uses a high frequency to heat said plurality of foods.

7. The method of claim 1 or 2, further comprising the step of deactivating said heat source when at least one of said plurality of detected temperatures is higher than said predetermined set-temperature.

8. The method of claim 1 or 2, further comprising the step of terminating control of said heat source within a specified time after all of said plurality of detected temperatures exceed said predetermined set-temperature.

9. A method for uniformly heating a plurality of foods using a heat source comprising the steps of:

inputting at least one of i) type of said plurality of foods, ii) heating patterns and iii) a set-temperature, detecting a temperature of at least one of said plurality of foods, estimating a temperature of at least another one of said plurality of foods, comparing i) the detected and ii) an estimated temperature with a predetermined set-temperature, controlling said heat source based upon the comparison result, detecting a temperature of at least one of said plurality of foods, estimating a temperature of at least another one of said plurality of foods, comparing said detected temperature and estimated temperature with said set-temperature and, activating said heat source when both the detected temperature and the estimated temperature are lower than the set-temperature, wherein a temperature of a first food of said plurality of foods is detected, said first food being placed farthest from the heat source, and a temperature of a second food of said plurality of foods is estimated, said second food being placed nearest to the heat source.

10. A method for uniformly heating a plurality of foods using a heat source comprising the steps of:

inputting at least one of i) type of said plurality of foods, ii) heating patterns and iii) a set-temperature, detecting a temperature of at least one of said plurality of foods, estimating a temperature of at least another one of said plurality of foods, comparing i) the detected and ii) an estimated temperature with a predetermined set-temperature, controlling said heat source based upon the comparison result, detecting a temperature of at least one of said plurality of foods, estimating a temperature of at least another one of said plurality of foods, comparing said detected temperature and estimated temperature with said set-temperature and, activating said heat source when both the detected temperature and the estimated temperature are lower than the set-temperature, wherein said detected temperature is a temperature of a largest food of said plurality of foods, and said estimated temperature is a temperature of a smallest food of said plurality of foods.

11. The method of claim 9 or 10, wherein said temperature is estimated based on at least two factors selected from the group consisting of a heating output, type of foods, weight of food, shape of food, and location of food.

12. The method of claim 9 or 10, wherein said temperature is estimated using a neuro-technology based on at least one of experimental data and theoretical analysis data.

13. The method of claim 9 or 10, wherein said heat source uses a high frequency to heat said plurality of foods.

14. The method of claim 9 or 10, further comprising the step of deactivating said heat source when one of the detected temperature and the estimated temperature is higher than the set-temperature.

15. The method of claim 9 or 10, further comprising the step of terminating control of said heat source within a specified time after both the detected temperature and the estimated temperature exceed the set-temperature.

16. A method for uniformly heating a plurality of foods using a heat source comprising the steps of:

inputting at least one of i) type of a plurality of foods, ii) heating patterns and iii) a set-temperature, detecting a temperature of at least one of said plurality of foods, estimating a temperature of at least another one of said plurality of foods, correcting said estimated temperature based on a detected temperature, comparing at least one of i) said detected temperature and ii) a corrected estimated temperature corrected with a predetermined set-temperature, controlling said heat source based upon the comparison result, estimating a corrected estimated temperature of at least another one of said plurality of foods based upon said estimated temperature and said corrected estimated temperature, and activating said heat source when both the detected temperature and the corrected estimated temperature are lower than the set-temperature, wherein at least one of said plurality of detected temperatures is a temperature of a largest food of the plurality of foods, and at least another one of said plurality of detected temperatures is a temperature of a smallest food of the plurality of foods.

17. A method for uniformly heating a plurality of foods using a heat source comprising the steps of:

inputting at least one of i) type of a plurality of foods, ii) heating patterns and iii) a set-temperature, detecting a temperature of at least one of said plurality of foods, estimating a temperature of at least another one of said plurality of foods, correcting said estimated temperature based on a detected temperature, comparing at least one of i) said detected temperature and ii) a corrected estimated temperature corrected with a predetermined set-temperature, controlling said heat source based upon the comparison result, estimating a corrected estimated temperature of at least another one of said plurality of foods based upon said estimated temperature and said corrected estimated temperature, and activating said heat source when both the detected temperature and the corrected estimated temperature are lower than the set-temperature, wherein at least one of said plurality of detected temperatures is a temperature of a largest food of the plurality of foods, and at least another one of said plurality of detected temperatures is a temperature of a smallest food of the plurality of foods, and wherein the temperature of said largest food is represented by a temperature at a center of the largest food, and the temperature of the smallest food is represented by a temperature on a surface of the smallest food.

18. The method of claim 16 or 17, wherein said temperature is estimated using a neuro-technology based on at least one of experimental data and theoretical analysis data.

19. The method of claim 16 or 17, wherein said heat source uses a high frequency to heat said plurality of foods.

20. The method of claim 16 or 17, wherein said plurality of foods are put into one bag, and are heated in the bag.

21. The method of claim 16 or 17, wherein said plurality of foods are at least one of i) wrapped and ii) sandwiched with a heat-conductive material, and said plurality of foods are heated.

22. The method of claim 16 or 17, further comprising the step of deactivating said heat source when one of the detected temperature and the corrected estimated temperature is higher than the set-temperature.

23. The method of claim 16 or 17, further comprising the step of terminating control of said heat source within a specified time after both the detected temperature and the corrected estimated temperature exceed the set-temperature.

24. A cooking heater apparatus for use with a heat source and a plurality of foods, said apparatus comprising:

input means for inputting a set temperature, a plurality of temperature detection means for detecting a respective plurality of temperatures of said plurality of foods, said respective plurality of temperatures detected at predetermined time intervals, comparison means for comparing a plurality of detected temperatures detected by said temperature detection means with a predetermined set-temperature, said comparison means comparing said plurality of temperatures detected at said predetermined time intervals with said set-temperature, and control means for at least one of activating and deactivating said heat source depending on a comparison result from said comparison means, wherein at least one of said plurality of temperature detection means detects a temperature of a first food of the plurality of foods, said first food placed farthest from said heat source, and at least another one of said plurality of temperature detection means detects a temperature of a second food of the plurality of foods, said second food placed nearest to said heat source.

25. A cooking heater apparatus for use with a heat source and a plurality of foods, said apparatus comprising:

input means for inputting a set temperature, a plurality of temperature detection means for detecting a respective plurality of temperatures of said plurality of foods, said respective plurality of temperatures detected at predetermined time intervals, comparison means for comparing a plurality of detected temperatures detected by said temperature detection means with a predetermined set-temperature, said comparison means comparing said plurality of temperatures detected at said predetermined time intervals with said set-temperature, and control means for at least one of activating and deactivating said heat source depending on a comparison result from said comparison means, wherein at least one of plurality of temperature detection means detects a temperature of a largest food of the plurality of foods, and at least another one of said plurality of temperature detection means detects a temperature of a smallest food of the plurality of foods.

26. The cooking heater apparatus of claim 24 or 25, wherein at least one of said plurality of temperature detection means is a contacting sensor, and at least another one of said plurality of temperature detection means is a non-contacting sensor.

27. The cooking heater apparatus of claim 24 or 25, wherein said heat source uses a high frequency to heat said plurality of foods.

28. The cooking heater apparatus of claim 24 or 25, wherein said control means one of i) activates said heat source when all of said plurality of detected temperatures are lower than the set-temperature and ii) deactivates said heat source when at least one of said plurality of detected temperatures is higher than the set-temperature.

29. The cooking heater apparatus of claim 24 or 25, wherein after a further predetermined time interval, if all of said plurality of detected temperatures exceed the set-temperature all controls of said control means are deactivated.

30. A cooking heater apparatus for use with a heat source and a plurality of foods, said apparatus comprising:

input means for inputting at least one of i) type of a plurality of foods, ii) heating patterns and iii) a set-temperature, temperature detection means for detecting a temperature of at least one of said plurality of foods, temperature estimating means for estimating a temperature of at least another one of said plurality of foods, comparison means for comparing i) a detected temperature detected by said temperature detection means and ii) an estimated temperature estimated by said temperature estimating means with a predetermined set-temperature, and control means for at least one of activating and deactivating said heat source depending on a comparison result from said comparison means, wherein said temperature detection means detects a temperature of a first food of the plurality of foods, said first food placed farthest from said heat source, and said temperature estimating means estimates a temperature of a second food of the plurality of foods, said second food placed nearest to said heat source.

31. A cooking heater apparatus for use with a heat source and a plurality of foods, said apparatus comprising:

input means for inputting at least one of i) type of a plurality of foods, ii) heating patterns and iii) a set-temperature, temperature detection means for detecting a temperature of at least one of said plurality of foods, temperature estimating means for estimating a temperature of at least another one of said plurality of foods, comparison means for comparing i) a detected temperature detected by said temperature detection means and ii) an estimated temperature estimated by said temperature estimating means with a predetermined set-temperature, and control means for at least one of activating and deactivating said heat source depending on a comparison result from said comparison means, wherein said temperature detection means detects a temperature of a largest food of the plurality of foods, and said temperature estimating means estimates a temperature of a smallest food of the plurality of the foods.

32. The cooking heater apparatus of claim 30 or 31, wherein said temperature estimating means considers at least two factors selected from the group consisting of a heating output, type of foods, weight of food, shape of food, and location of food, and estimates the estimated temperature.

33. The cooking heater apparatus of claim 30 or 31, wherein said temperature estimating means employs at least one of i) a neuro-technology based on experimental data and ii) a theoretical analysis data.

34. The cooking heater apparatus of claim 30 or 31, wherein said heat source uses a high frequency to heat said plurality of foods.

35. The cooking heater apparatus of claim 30 or 31, wherein said control means one of i) activates said heat source when both of the detected temperature and the estimated temperature are lower than the set-temperature and ii) deactivates said heat source when at least one of the detected temperature and the estimated temperature is higher than the set-temperature.

36. The cooking heater apparatus of claim 30 or 31, wherein after a predetermined time interval, if both the detected temperature and the estimated temperature exceed the set-temperature all controls of said control means are deactivated.

37. A cooking heater apparatus for use with a heat source and a plurality of foods, said apparatus comprising:

input means for inputting at least one of i) type of said plurality of foods, ii) heating patterns and iii) a set-temperature, temperature detection means for detecting a detected temperature of at least one of said plurality of foods, temperature estimating means for estimating an estimated temperature of at least another one of said plurality of foods, estimated temperature correcting means for correcting said estimated temperature based on said detected temperature and generating a corrected estimated temperature, comparison means for comparing said detected temperature and said corrected estimated temperature with a predetermined set-temperature, and control means for at least one of activating and deactivating said heat source depending on the comparison result from said comparison means, wherein at least one of said plurality of detected temperatures is a temperature of a largest food of the plurality of foods, and at least another one of said plurality of detected temperatures is a temperature of a smallest food of the plurality of foods.

38. A cooking heater apparatus for use with a heat source and a plurality of foods, said apparatus comprising:

input means for inputting at least one of i) type of said plurality of foods, ii) heating patterns and iii) a set-temperature, temperature detection means for detecting a detected temperature of at least one of said plurality of foods, temperature estimating means for estimating an estimated temperature of at least another one of said plurality of foods, estimated temperature correcting means for correcting said estimated temperature based on said detected temperature and generating a corrected estimated temperature, comparison means for comparing said detected temperature and said corrected estimated temperature with a predetermined set-temperature, and control means for at least one of activating and deactivating said heat source depending on the comparison result from said comparison means, wherein at least one of said plurality of detected temperatures is a temperature of a largest food of the plurality of foods, and at least another one of said plurality of detected temperatures is a temperature of a smallest food of the plurality of foods, and wherein the temperature of said largest food is represented by a temperature at a center of the largest food, and the temperature of the smallest food is represented by a temperature on a surface of the smallest food.

39. The cooking heater apparatus of claim 37 or 38, wherein said temperature estimating means employs at least one of i) a neuro-technology based on experimental data and ii) a theoretical analysis data.

40. The cooking heater apparatus of claim 37 or 38, wherein said heat source uses a high frequency to heat said plurality of foods.

41. The cooking heater apparatus of claim 37 or 38, wherein said control means one of i) activates said heat source when both of said detected temperature and said corrected estimated temperature are lower than the set-temperature and ii) deactivates said heat source when at least one of the detected temperature and the corrected estimated temperature is higher than the set-temperature.

42. The cooking heater apparatus of claim 37 or 38, wherein after a predetermined time interval, if both the detected temperature and the corrected estimated temperature exceed the set-temperature all controls of said control means are deactivated.

* * * * *